US008628067B2

(12) United States Patent
Pearce et al.

(10) Patent No.: US 8,628,067 B2
(45) Date of Patent: Jan. 14, 2014

(54) CUSHIONS COMPRISING CORE STRUCTURES AND RELATED METHODS

(75) Inventors: Tony M. Pearce, Alpine, UT (US); Joseph T. Nilson, Alpine, UT (US)

(73) Assignee: Edizone, LLC, Alpine, UT (US)

( * ) Notice: Subject to any disclaimer, the term of this patent is extended or adjusted under 35 U.S.C. 154(b) by 699 days.

(21) Appl. No.: 12/784,346

(22) Filed: May 20, 2010

(65) Prior Publication Data

US 2010/0229308 A1 Sep. 16, 2010

Related U.S. Application Data

(63) Continuation-in-part of application No. 12/287,047, filed on Oct. 3, 2008, now Pat. No. 8,434,748.

(60) Provisional application No. 61/216,787, filed on May 21, 2009.

(51) Int. Cl.
*A47C 27/00* (2006.01)

(52) U.S. Cl.
USPC ..... 267/142; 5/655.5

(58) Field of Classification Search
USPC ..... 267/103, 110, 142, 145, 146; 5/654, 5/655.2–655.5, 739; 428/36.1, 35.7, 99
See application file for complete search history.

(56) References Cited

U.S. PATENT DOCUMENTS

| | | | | |
|---|---|---|---|---|
| 1,228,783 | A | | 6/1917 | Kerivan |
| 2,029,370 | A | | 2/1936 | Heldenbrand |
| 2,184,517 | A | | 12/1939 | Duvall et al. |
| 2,225,895 | A | | 12/1940 | Atkinson |
| 2,291,869 | A | | 8/1942 | Blaha |
| 2,385,870 | A | | 10/1945 | Walter et al. |
| 2,458,588 | A | | 1/1949 | Gordon et al. |
| 2,491,557 | A | | 12/1949 | Goolsbee |
| 2,617,751 | A | | 11/1952 | Bickett |
| 2,655,369 | A | | 10/1953 | Musilli |
| 2,672,183 | A | | 3/1954 | Forsyth |
| 2,715,435 | A | * | 8/1955 | Rymland ..... 267/93 |

(Continued)

FOREIGN PATENT DOCUMENTS

| | | |
|---|---|---|
| EP | 0614622 A1 | 9/1994 |
| GB | 1106958 | 3/1968 |

(Continued)

OTHER PUBLICATIONS

Walker, Benjamin M., et al., Handbook of Thermoplastic Elastomers, Second Edition, 1988, pp. 26-28, Van Nostrand Reinhold Company, Inc., New York, New York.

(Continued)

*Primary Examiner* — Christopher Schwartz
(74) *Attorney, Agent, or Firm* — TraskBritt

(57) ABSTRACT

Cushions include a plurality of core structures and a support material at least partially surrounding each core structure of the plurality of core structures. The core structures and support material comprise different deformable polymer materials. Each of the core structures may be configured as a column having a column axis. Methods of forming cushions include forming a plurality of core structures, and at least partially surrounding each core structure of the plurality of core structures with a support material comprising a second, different deformable polymer material. The core structures may be configured such that each core structure is integrally interconnected along a length thereof to no more than two other core structures of the plurality of core structures.

25 Claims, 6 Drawing Sheets

(56) References Cited

U.S. PATENT DOCUMENTS 2,814,053 A 11/1957 Sevik
2,887,425 A 5/1959 Holland
2,979,739 A 4/1961 Krakauer
3,043,731 A 7/1962 Hill
3,197,357 A 7/1965 Schulpen
3,222,697 A 12/1965 Scheermesser
3,308,491 A 3/1967 Spence
3,407,406 A 10/1968 Werner et al.
3,459,179 A 8/1969 Olesen
3,462,778 A 8/1969 Whitney
3,518,786 A 7/1970 Holtvoigt
3,529,368 A 9/1970 Canfield
3,552,044 A 1/1971 Wiele
3,605,145 A 9/1971 Graebe
3,748,669 A 7/1973 Warner
3,748,779 A 7/1973 Cherk et al.
3,801,420 A 4/1974 Anderson
3,893,198 A 7/1975 Blair
3,940,811 A 3/1976 Tomikawa et al.
3,968,530 A 7/1976 Dyson
3,986,213 A 10/1976 Lynch
4,038,762 A 8/1977 Swan, Jr.
4,083,127 A 4/1978 Hanson
4,144,658 A 3/1979 Swan, Jr.
4,163,297 A 8/1979 Neumark
4,229,546 A 10/1980 Swan, Jr.
4,243,754 A 1/1981 Swan, Jr.
4,247,963 A 2/1981 Reddi
4,252,910 A 2/1981 Schaefer
4,255,202 A 3/1981 Swan, Jr.
4,256,304 A 3/1981 Smith et al.
4,274,169 A 6/1981 Standiford
4,279,044 A 7/1981 Douglas
4,292,701 A 10/1981 Woychick
4,335,476 A 6/1982 Watkin
4,335,478 A 6/1982 Pittman
4,369,284 A 1/1983 Chen
4,370,769 A 2/1983 Herzig et al.
4,378,396 A 3/1983 Urai et al.
4,383,342 A 5/1983 Forster
4,422,194 A 12/1983 Viesturs et al.
4,457,032 A 7/1984 Clarke
4,467,053 A 8/1984 Markle
4,472,847 A 9/1984 Gammons et al.
4,483,029 A 11/1984 Paul
4,485,505 A 12/1984 Paul
4,485,568 A 12/1984 Landi et al.
4,498,205 A 2/1985 Hino
4,541,136 A 9/1985 Graebe
4,572,174 A 2/1986 Eilender et al.
4,588,229 A 5/1986 Jay
4,614,632 A 9/1986 Kezuka et al.
4,618,213 A 10/1986 Chen
4,628,557 A 12/1986 Murphy
4,660,238 A 4/1987 Jay
4,670,925 A * 6/1987 Carussi ..... 5/655.9
4,686,724 A 8/1987 Bedford
4,698,864 A 10/1987 Graebe
4,709,431 A 12/1987 Shaktman
4,713,854 A 12/1987 Graebe
4,726,624 A 2/1988 Jay
4,728,551 A 3/1988 Jay
4,737,998 A 4/1988 Johnson, Sr.
4,744,564 A 5/1988 Yamada
4,761,843 A 8/1988 Jay
4,842,330 A 6/1989 Jay
4,913,755 A 4/1990 Grim
4,945,588 A 8/1990 Cassidy et al.
4,952,190 A 8/1990 Tarnoff et al.
4,952,439 A 8/1990 Hanson
4,953,913 A 9/1990 Graebe
4,959,059 A 9/1990 Eilender et al.
4,967,433 A 11/1990 Neal
5,010,608 A 4/1991 Barnett et al.
5,015,313 A 5/1991 Drew et al.
5,018,790 A 5/1991 Jay
5,020,176 A 6/1991 Dotson
5,027,801 A 7/1991 Grim
5,039,567 A 8/1991 Landi et al.
5,052,068 A 10/1991 Graebe
5,053,436 A 10/1991 Delgado
5,058,291 A 10/1991 Hanson
5,074,620 A 12/1991 Jay et al.
5,079,786 A 1/1992 Rojas
5,079,787 A 1/1992 Pollmann
5,093,138 A 3/1992 Drew et al.
5,100,712 A 3/1992 Drew et al.
5,103,518 A 4/1992 Gilroy et al.
5,111,544 A 5/1992 Graebe
5,147,685 A 9/1992 Hanson
5,149,173 A 9/1992 Jay et al.
5,152,023 A 10/1992 Graebe
5,153,956 A 10/1992 Nold
5,163,196 A 11/1992 Graebe et al.
5,171,766 A 12/1992 Mariano et al.
5,172,494 A 12/1992 Davidson
5,180,619 A 1/1993 Landi et al.
5,190,504 A 3/1993 Scatterday
5,191,752 A 3/1993 Murphy
5,201,780 A 4/1993 Dinsmoor, III et al.
5,203,607 A 4/1993 Landi
5,204,154 A 4/1993 Drew et al.
5,211,446 A 5/1993 Jay et al.
5,243,722 A 9/1993 Gusakov
5,255,404 A 10/1993 Dinsmoor, III et al.
5,262,468 A 11/1993 Chen
5,282,286 A 2/1994 MacLeish
5,289,878 A 3/1994 Landi et al.
5,314,735 A 5/1994 Kronberg
5,330,249 A 7/1994 Weber et al.
5,334,646 A 8/1994 Chen
5,334,696 A 8/1994 Olson et al.
5,335,907 A 8/1994 Spector
5,336,708 A 8/1994 Chen
5,352,023 A 10/1994 Jay et al.
5,360,653 A 11/1994 Ackley
5,362,834 A 11/1994 Schapel et al.
5,369,828 A 12/1994 Graebe
5,403,642 A 4/1995 Landi et al.
5,421,874 A 6/1995 Pearce
5,429,852 A 7/1995 Quinn
5,444,881 A 8/1995 Landi et al.
5,445,861 A 8/1995 Newton et al.
5,452,488 A 9/1995 Reinhardt
5,456,072 A 10/1995 Stern
5,490,299 A 2/1996 Dinsmoor, III et al.
5,496,610 A 3/1996 Landi et al.
5,508,334 A 4/1996 Chen
5,513,402 A 5/1996 Schwartz
5,549,743 A 8/1996 Pearce
5,592,706 A 1/1997 Pearce
5,617,595 A 4/1997 Landi et al.
5,626,657 A 5/1997 Pearce
5,633,286 A 5/1997 Chen
5,636,395 A 6/1997 Serda
5,689,845 A 11/1997 Sobieralski
5,749,111 A 5/1998 Pearce
5,881,409 A 3/1999 Pearce
5,994,450 A 11/1999 Pearce
6,026,527 A 2/2000 Pearce
6,115,861 A 9/2000 Reeder et al.
6,187,837 B1 2/2001 Pearce
6,241,695 B1 6/2001 Dabir
6,413,458 B1 7/2002 Pearce
6,490,744 B1 12/2002 Schulz, Jr.
6,498,198 B2 12/2002 Pearce
6,598,321 B2 7/2003 Crane et al.
6,704,961 B2 3/2004 Kienlein
6,797,765 B2 9/2004 Pearce
6,865,759 B2 3/2005 Pearce
6,905,431 B2 6/2005 Jiang et al.
6,908,662 B2 6/2005 Pearce
7,060,213 B2 6/2006 Pearce
7,076,822 B2 7/2006 Pearce

(56) References Cited

U.S. PATENT DOCUMENTS

| | | | | |
|---|---|---|---|---|
| 7,138,079 | B2 | 11/2006 | Pearce | |
| 7,444,703 | B2 | 11/2008 | Jansen | |
| 7,666,341 | B2 | 2/2010 | Pearce | |
| 7,730,566 | B2 * | 6/2010 | Flick et al. | 5/655.5 |
| 8,075,981 | B2 | 12/2011 | Pearce et al. | |
| 8,424,137 | B1 | 4/2013 | Pearce et al. | |
| 8,434,748 | B1 | 5/2013 | Pearce et al. | |
| 2002/0061384 | A1 | 5/2002 | Yates | |
| 2004/0172766 | A1 | 9/2004 | Formenti | |
| 2005/0223667 | A1 | 10/2005 | McCann et al. | |
| 2006/0194925 | A1 | 8/2006 | Pearce | |
| 2007/0246157 | A1 | 10/2007 | Mason et al. | |
| 2009/0246449 | A1 * | 10/2009 | Jusiak | 428/99 |
| 2010/0227091 | A1 | 9/2010 | Pearce | |
| 2012/0015151 | A1 | 1/2012 | Pearce et al. | |

FOREIGN PATENT DOCUMENTS

| | | | |
|---|---|---|---|
| GB | 1261475 | | 1/1972 |
| GB | 2150431 | A | 7/1985 |
| KR | 20-0315625 | | 6/2003 |
| KR | 20-0380271 | | 3/2005 |
| KR | 10-2007-0026934 | | 3/2007 |
| WO | 88/10339 | A1 | 12/1988 |
| WO | 91/04290 | A1 | 4/1991 |
| WO | 92/14387 | A1 | 9/1992 |
| WO | 96/39065 | A1 | 12/1996 |
| WO | 97/17001 | A1 | 5/1997 |

OTHER PUBLICATIONS

U.S. Appl. No. 61/039,259 filed Mar. 25, 2008, 26 pages.

International Search Report and Written Opinion for International Application No. PCT/US2010/035587, Publication No. WO 2010/135542, mailed Jan. 3, 2011 (7 pages).

International Search Report and Written Opinion for International Application No. PCT/US2010/035602, Publication No. WO 2010/135550, mailed Dec. 22, 2010 (8 pages).

International Search Report and Written Opinion for International Application No. PCT/US2010/035635, Publication No. WO 2010/135565, mailed Dec. 27, 2010.

U.S. Appl. No. 12/287,056, filed Oct. 3, 2008, 13 pages.

* cited by examiner

CUSHIONS COMPRISING CORE STRUCTURES AND RELATED METHODS

CROSS-REFERENCE TO RELATED APPLICATIONS

This application claims the benefit of U.S. Provisional Patent Application Ser. No. 61/216,787, which was filed on May 21, 2009 and entitled "Cushions with Individually Pocketed Non-Linear Members, Gel Springs with Joiner Ribs, Gel Cores," which is incorporated herein in its entirety by this reference. This application is a continuation-in-part of U.S. patent application Ser. No. 12/287,047, which was filed on Oct. 3, 2008 and entitled "Gel Springs," now U.S. Pat. No. 8,434,748, issued May 7, 2013, which is also incorporated herein in its entirety by this reference.

TECHNICAL FIELD

Embodiments of the present invention relate to cushions used to cushion at least a portion of a body of a person, and to methods of making and using such cushions.

BACKGROUND

Cushions for cushioning at least a portion of a body of a person are fabricated in a wide variety of configurations and using a wide variety of materials. For example, polymeric foams are often used to form cushions. Cushions have also been fabricated using what are referred to in the art as "gelatinous elastomeric materials," "gel elastomers," "gel materials," or simply "gels." These terms are used synonymously herein, and mean a plasticized elastomeric polymer composition comprising at least 15% plasticizer by weight, having a hardness that is softer than 50 on the Shore A scale of durometer, and a tensile elongation at failure of at least about 500%. Such gels, methods for making such gels, and applications in which such gels may be used are disclosed in, for example, U.S. Pat. No. 5,749,111, which issued May 12, 1998 to Pearce, U.S. Pat. No. 5,994,450, which issued Nov. 30, 1999 to Pearce, and in U.S. Pat. No. 6,026,527, which issued Feb. 22, 2000 to Pearce, each of which patents is incorporated herein in its entirety by this reference.

BRIEF SUMMARY

In some embodiments, the present invention includes cushions that comprise a plurality of core structures and a support material at least partially surrounding each core structure of the plurality of core structures. Each core structure of the plurality of core structures comprises a first deformable polymer material, and is configured as a column having a column axis. The support material comprises a second deformable polymer material differing in composition from the first deformable polymer material of the plurality of core structures. Each core structure of the plurality of core structures is integrally interconnected along a length thereof to no more than two other core structures of the plurality of core structures.

In additional embodiments, the present invention includes cushions that comprise a plurality of core structures and a support material at least partially surrounding each core structure of the plurality of core structures. Each core structure of the plurality of core structures comprises a gel material and is configured as a column having a column axis. Each core structure of the plurality of core structures is interconnected along a length thereof to no more than two other core structures of the plurality of core structures. The support material comprises a unitary body of deformable polymer foam having a plurality of recesses therein. Each core structure of the plurality of core structures is respectively disposed within a recess of the plurality of recesses in the unitary body of support material. Each core structure of the plurality of core structures is configured to buckle within a recess of the plurality of recesses in the unitary body of deformable polymer foam when compressed along the column axis of the core structure to a pressure beyond a threshold pressure level.

In further embodiments, the present invention includes methods of forming cushions that comprise forming a plurality of core structures each comprising a first deformable polymer material and configured as a column having a column axis. Each core structure of the plurality of core structures is at least partially surrounded with a support material comprising a second deformable polymer material differing in composition from the first deformable polymer material of the plurality of core structures. Each core structure of the plurality of core structures is configured to be integrally interconnected along a length thereof to no more than two other core structures of the plurality of core structures.

DETAILED DESCRIPTION

The illustrations presented herein are not actual views of any particular cushion, or feature thereof, but are merely idealized representations, which are employed to describe embodiments of the invention.

Figure 1A:
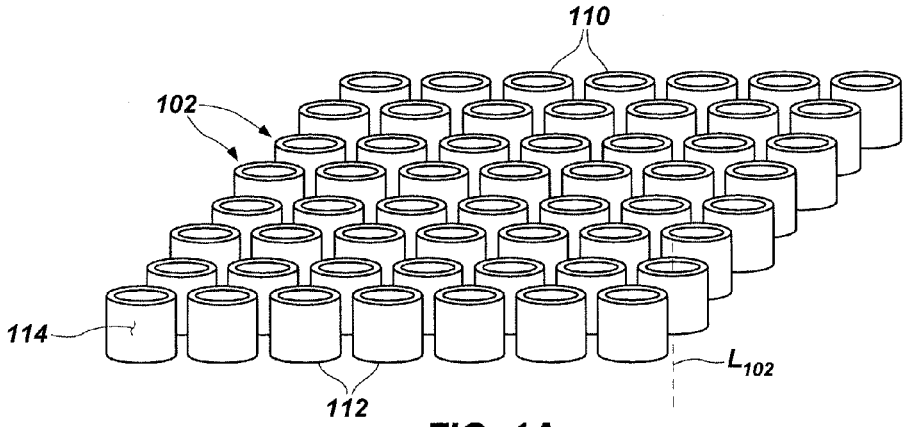
FIGS. 1A through 1C illustrate an embodiment of a cushion of the present invention that includes hollow, cylindrical core structures of a first material disposed within a surrounding medium comprising a different material.
Figure 1B:
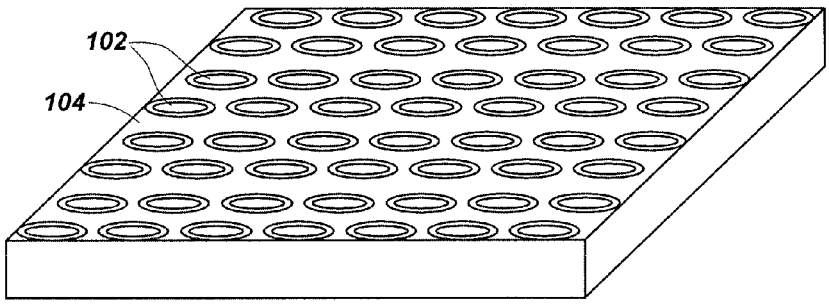
Figure 1C:
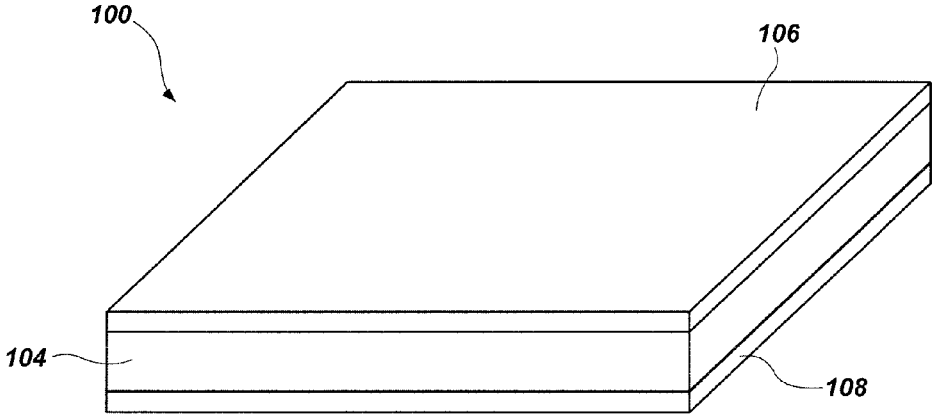

FIGS. 1A through 1C illustrate an embodiment of a cushion 100 (FIG. 1C) of the present invention. The complete cushion 100 is shown in FIG. 1C. The cushion 100 includes a plurality of core structures 102, which are shown isolated from other features of the cushion 100 in FIG. 1A. As shown in FIG. 1B, the core structures 102 are disposed within and surrounded by a support material 104 comprising a material that differs from that of the core structures 102. As shown in FIG. 1C, the cushion 100 may further comprise at least one of a top layer 106 and a bottom layer 108 disposed over the top ends 110 and the bottom ends 112 (FIG. 1A) of the core structures 102.

As discussed in further detail below, each of the core structures 102 may comprise an individual hollow or solid structure that is laterally isolated from the other core structures 102. Furthermore, each of the core structures 102 may comprise a gel, as discussed in further detail below.

As shown in FIG. 1A, each core structure 102 may comprise a column having a column axis $L_{102}$. The column axis $L_{102}$ may be oriented generally perpendicular to the major surfaces of the cushion that are configured to support at least a portion of a body of a person. In some embodiments, each core structure 102 may have a shape that is symmetric about at least one plane containing the column axis $L_{102}$. In some embodiments, each core structure 102 may have a shape that is symmetric about all planes containing the column axis $L_{102}$. For example, each core structure 102 may be generally cylindrical, as shown in FIG. 1A. Additionally, each core structure 102 may be hollow, and generally cylindrical (i.e., generally tubular), as shown in FIG. 1A. In additional embodiments, each core structure 102 may have a shape that is asymmetric about one or more planes containing the column axis $L_{102}$. In some embodiments, each of the core structures 102 may have a length (measured along the column axis $L_{102}$) that is longer than the average outer diameter of the core structure 102. In other embodiments, each of the core structures 102 may have a length that is shorter than the average outer diameter of the core structure 102. In yet further embodiments, each of the core structures 102 may have a length that is at least substantially equal to the average outer diameter of the core structure 102.

The core structures 102 may have any hollow or solid cross-sectional shape at any plane orthogonal to the intended principle cushioning direction, such as circular, square, rectangular, triangular, star-shaped, hexagonal, octagonal, pentagonal, oval, I-Beam, H-Beam, E-Beam, or irregularly shaped. The core structures 102 can be of any shape, and do not need to have a uniform cross-sectional shape along the length of the core structures 102. For example, the top ends 110 of the core structures 102 may have a square cross-sectional shape, the bottom ends 112 of the core structures 102 may have an oval cross-sectional shape, and the cross-sectional shape of the core structures 102 may transition from the square shape to the oval shape along the length of the core structures 102. In some embodiments, the core structures 102 may have varying average diameters along the lengths of the core structures 102. In embodiments in which the core structures 102 are hollow, the wall thicknesses of the core structures 102 may vary along the lengths of the core structures 102. Furthermore, in some embodiments, the core structures 102 may have a material composition that varies along the lengths of the core structures 102.

In the same cushion 100, one or more core structures 102 may be different from one or more other core structures 102 of the cushion in shape, size, material composition, etc. The spacing between core structures 102 in a cushion 100 may be uniform, or it may vary within the cushion 100. The outer lateral side surfaces of the core structures 102 may be vertically oriented, or they may be oriented at an acute angle other than zero degrees (0°) to vertical, and the angle may vary (continuously or in a step-wise manner) along the length of the core structures 102.

The core structures 102 are shown as having uniform lengths or heights (i.e., the dimension extending along the column axis $L_{102}$ of the core structures 102), but they can have varying heights in additional embodiments. Such configurations may be desirable in cushions where a top cushioning surface having a contour may be desirable, such as, for example, in wheelchair cushions.

As non-limiting examples, each core structure 102 may comprise a wall 114 having an average thickness of between about one-tenth of a centimeter (0.1 cm) and about five centimeters (5 cm). Furthermore, each core structure 102 may have an average outer diameter of between about one-half of a centimeter (0.5 cm) and about twelve centimeters (12 cm). The core structures 102 may have a length (i.e., a height) of between about one-half of a centimeter (0.5 cm) and about thirty centimeters (30 cm). The shortest distance between the outer walls 114 of adjacent core structures 102 may be between about one-half of a centimeter (0.5 cm) and about fifteen centimeters (15 cm).

Individual core structures 102 may be configured to buckle when compressed in the intended cushioning direction (e.g., in a direction at least substantially parallel to the column axis $L_{102}$ of the core structures 102) beyond a threshold load. Furthermore, individual core structures 102 may be configured to deform when sheared in a direction transverse to the intended principle cushioning direction (e.g., in a direction generally perpendicular to the column axis $L_{102}$) to allow relative transverse movement between the top ends 110 and the bottom ends 112 of the core structures 102.

Referring to FIG. 1B, at least some of the core structures 102 may be laterally surrounded (i.e., in directions perpendicular to the column axis $L_{102}$ of the core structures 102) by a support material 104 comprising a material that differs from that of the core structures 102. In other words, the space or spaces between the core structures 102 may be filled with a surrounding medium along at least a portion of the length of the core structures 102. In other embodiments, the core structures 102 may be completely encapsulated by the support material 104. In other words, the support material 104 may extend over and around at least one of the top ends 110 and the bottom ends 112 of the core structures 102. In embodiments in which the core structures 102 are hollow, the interior space within the hollow core structures 102 may be at least partially filled with the support material 104. In other embodiments, however, the interior space within such hollow core structures 102 may not be filled with the support material 104, and the space may be occupied by another form of matter (e.g., air, a gas, a liquid, another solid or foamed solid material differing from that of the support material 104 and the core structures 102, etc.).

In some embodiments, the core structures 102 may comprise a gel, and the support material 104 may comprise a polymeric foam material. The core structures 102 may be formed entirely from a gel, or they may have a composition comprising a gel and one or more additional non-gel materials. The core structures 102 may be bare, un-coated core structures 102, or they may be coated or covered with another material. The polymeric foam material of the support material 104 may comprise, for example, polyurethane foam (conventional foam or memory foam), polyethylene foam, foamed gel, latex foam (foam rubber), or foamed elastomer of any type. In other embodiments, the surrounding material may comprise a polymeric material that is not a foam, but that can compress, shear, stretch, and/or move with the core structures 102 while they are under compressive loading while cushioning. For example, the surrounding medium may comprise an elastomer. The support material 104 may have a composition and configuration selected to allow the core structures 102 to buckle or otherwise compress stably or unstably, in a linearly elastic fashion or a non-linearly elastic fashion, and to return to its original shape along with the core structures 102 when released from the compressive load.

The core structures 102 may have a composition and configuration selected to cause the core structures 102 to be structurally stable so as to stay oriented toward the intended cushioning direction when not under load from a cushioned object. In other embodiments, the support material 104 may be used to cause the core structures 102 to stay oriented toward the intended cushioning direction when not under load from a cushioned object. The support material 104 may be used to maintain desirable spacing between the core structures 102 (including, if desired, to maintain them in physical contact with one another).

The core structures 102 may not be physically attached to any connecting material, and may not be attached to the support material 104. In some embodiments, the composition and configuration of the core structures 102 and/or the support material 104 may be such that the core structures 102 remain properly spaced and oriented when not under load without being attached to any other material. For example, when polyurethane foam is used as the support material 104, and is disposed in the spaces between the core structures 102 and, if hollow, also in the interior of the core structures 102, as well as above and below the core structures 102, the core structures 102 will be completely trapped (i.e., encapsulated) in the foam. In such configurations, the core structures 102 may be caused to stay in the desired location and orientation during compression and removal of compressive loads by the support material 104.

In embodiments in which the core structures 102 are hollow, the hollow core structures 102 may stay oriented even if the interior space of the core structures 102 is not filled with foam or another support material 104, provided that the composition and shape of the core structure is such that it cannot become permanently, wrongly positioned within the foam or other support material 104.

In some embodiments, the core structures 102 may be attached to one another. For example, the core structures may have a gel skin (i.e., a relatively thin layer of gel) integral with either the top ends 110 of the core structures 102 or the bottom ends 112 of the core structures 102, and a foam layer or other support material 104 having holes that match the shapes and locations of the core structures 102 may be fitted over the opposite, non-skinned ends of the core structures 102. As another example, the core structures 102 may be heat fused to a fabric on either the top ends 110 of the core structures 102 or the bottom ends 112 of the core structures 102, and a foam layer or other support material 104 with holes that match the shapes and locations of the core structures 102 may be fitted over the opposite ends of the core structures 102 and glued to the fabric. Optionally, another fabric then may be heat fused to the opposite ends of the core structures 102. In such embodiments, a foam layer may optionally be provided over (e.g., glued to) the fabric at the top ends 110 and/or the bottom ends 112 of the core structures 102. Whether fabric or another connecting layer is used or not, the support material 104 in the space or spaces between the core structures 102 may impart stability to the core structures 102 that will help the gel cores function properly. If fabric is used and a bond between the fabric and the core structures 102 fails, the core structures 102 may continue to operate properly.

The use of fabric or another connecting layer (e.g., a gel skin) is optional. If a connecting layer is used at one end of the core structures 102, a second connecting layer is not required to be used (but may be used) at the opposite end of the core structures 102. The use of a single connecting layer may be advantageous for some configurations of core structures 102. For example, a hollow, cylindrical core structure 102 of gel that is about five centimeters (5 cm) in diameter, about five centimeters (5 cm) in height, and has a wall thickness of about twenty-five hundredths of a centimeter (0.25 cm), and that is not filled with foam or any other support material 104, may collapse or deform within the cylindrical apertures of the support material 104 in which the core structures 102 are disposed under a compressive load while cushioning, and may not return to its proper orientation and configuration after release of the compressive load. Bonding at least one of the top ends 110 and the bottom ends 112 of such core structures 102 to fabric or another connecting layer may assist in preventing such occurrences.

In some embodiments, the core structures 102 may be configured to buckle at a threshold compressive load. If the core structures 102 are designed to buckle, the buckling causes the load vs. deflection (i.e., stress vs. strain) curve to be non-linear. In other words, a plot of the stress as a function of strain will deviate from a straight elastic line, as shown by the non-limiting examples of load vs. deflection curves for buckling core structures 102 shown in FIGS. 6A through 6D. In comparison with a linearly elastic cushion, pressure is reduced under the buckling and/or buckled core structures 102, and the load from the cushioning object that is thus not carried by the buckling and/or buckled core structures 102 is redistributed to surrounding core structures 102 that have not buckled, which may tend to equalize pressure over the cushioned object.

The pressure acting on the cushioned object may also be reduced because buckling of the core structures 102 allows the cushion 100 to conform to the shape of the cushioned object, which may result in an increase in the surface area of the cushioned object over which the pressure is applied. Since pressure is load divided by surface area, increasing the surface area over which the load is applied lowers the pressure acting on the cushioned object.

Core structures 102 within a support material 104 may not buckle as freely as gel springs (as disclosed in U.S. patent application Ser. No. 12/287,047, which was filed on Oct. 3, 2008 and entitled "Gel Springs") or shared-wall hollow buckling columns (as disclosed in U.S. Pat. No. 5,749,111) due to the support material 104 (e.g., foam) disposed in the space between the core structures 102, which stabilizes core structures and hinders buckling of the core structures 102 into the space occupied by the support material 104. If the core structure 102 is hollow and the interior space within the core structure 102 is filled with foam (or another support material 104), the foam within the interior space also hinders buckling of the core structure 102 into the interior space within the core structure 102, and, thus, further stabilizes the core structure 102. However, the foam or other support material 104 may be sufficiently soft to allow displacement of the foam or other support material 104 and buckling to occur into the space outside and/or inside the core structure 102. In embodiments in which the interior space within a hollow core structure 102 is not filled with foam or other support material 104, the core structure 102 may freely buckle into the interior space within the hollow core structure 102. The hindrance of buckling due of the core structure due to support from foam may allow thinner-walled core structures when the core structures are made from gel, which may allow for less expensive cushions since gel is generally more expensive than foam.

In embodiments in which hollow core structures 102 are filled with foam or another support material 104, the foam or other support material 104 disposed within the interior spaces within the hollow core structures 102 may differ from the foam or other support material 104 disposed outside the core structures 102. For example, the foam or other support material 104 disposed within the interior spaces within the hollow core structures 102 may have a higher stiffness (i.e., elastic modulus), or a lower stiffness, relative to a stiffness of the foam or other support material 104 disposed outside the core structures 102.

In embodiments that include either hollow or solid core structures 102, the foam or other support material 104 may have different stiffnesses at different locations within the cushion 100. The foam or other support material 104 can be of varying height and height location relative to the height of the core structures 102 (i.e., the length along the column axis $L_{102}$ of the core structures 102). Furthermore, the core structures 102 of the cushion 100 may include core structures 102 of different shapes, heights, and/or stiffnesses throughout the cushion 100. By selectively altering such features and characteristics of the core structures 102 and the support material 104 throughout the cushion 100, the cushioning and/or buckling characteristics of the cushion may be selectively designed and tailored.

As one non-limiting example, the cushion 100 may comprise a mattress for a bed that is configured to support the entire body of a person thereon. In such an embodiment, the support material 104 may comprise a foam disposed between hollow core structures 102, as shown in FIG. 1B. The support material 104, however, may extend from the bottom ends 112 of the core structures 102 only to about half the height (i.e. , length) of the core structures 102, such that an upper portion of each of the core structures 102 (including the top end 110) protrudes out from an upper surface of the foam by, for example, about two and a half centimeters (2.5 cm). The top ends 110 of the protruding portions of the core structures define the top layer of the mattress, but for an optional top layer 106 and any cover or cover assembly provided over the mattress. For example, a quilted mattress cover may be applied over the core structures 102 (but not bonded to the core structures). In such a configuration, the top ends 110 of the core structures 102 are very close to the body of a person supported on the mattress.

As previously discussed, the composition and configuration of the core structures 102 and the support material 104 may be selected to allow the top ends 110 of the core structures 102 to move laterally relative to the bottom ends 112 of the core structures 102 when a shear stress is applied to the cushion 100. Provided the support material 104 is not overly restrictive, such shear stresses may be relieved by the relatively easy lateral movement of the top of the cushion relative to the bottom of the cushion.

Energy is required to cause a core structure 102 to buckle and to return to an unbuckled configuration. Thus, the absorption of energy by the core structures 102 while buckling and returning to an unbuckled configuration results in absorption of shocks and attenuation of vibrations by the cushion. It also takes energy to compress or elongate the material of the core structures 102 (even in the absence of buckling). Thus, the composition of the core structures 102 may be selected to comprise a material that is relatively efficient in absorbing shocks and attenuating vibrations to help the cushion 100 absorb shocks and attenuate vibrations. For example, elastomeric gels are relatively efficient in absorbing shocks and attenuating vibrations.

Thus, embodiments of cushions 100 of the invention may provide improved equalization and/or redistribution of pressure, shear relief, and/or shock absorption and/or vibration attenuation, when compared to at least some previously known cushions. In addition, when the core structures 102 are configured to buckle at threshold-buckling load, the cushions may further provide support and alignment. For example, in a mattress, the core structures 102 under the most protruding body parts (e.g., hips and shoulders) can buckle, while the core structures 102 under the least protruding body parts hold firm without buckling (although they may compress due to a load thereon that is below the threshold-buckling load). The torso of the supported body is supported, while the spine and back of the supported body is maintained in alignment (all while eliminating high pressure points on the hips and shoulders, or other protruding areas). If the hips and shoulders were not allowed to sink in, the torso would not be sufficiently supported, and the torso and, hence, the spine would have to bend to contact and be supported by the mattress. Thus, a mattress comprising core structures 102 in a support material 104, as disclosed herein, may result in a reduction in excessive pressure points on a body supported by the mattress or other cushion, and may improve the alignment of the spine of the body of a person sleeping on the mattress. The result may be less tossing and turning, and less likelihood of back or neck pain.

The core structure shown in FIG. 1A may be designed to buckle at a threshold-buckling load. The core structures 102 of FIG. 1A have a uniform cylindrical cross-sectional shape along their lengths (i.e., along the column axis $L_{102}$), and are arranged at uniform spacing in an ordered array of rows and columns. The intended cushioning direction is along the column axis $L_{102}$ of the core structures 102. Not all core structures of all embodiments of the invention will have a straight and parallel column axis, as are the axis $L_{102}$ of the core structures 102 of FIG. 1A.

The direction from which a cushioned object will approach and impinge on the cushion 100 may be considered when designing embodiments of cushions of the invention. Some cushions need to provide cushioning in any of several directions (for example, in a number of differing degrees away from a principle cushioning direction, such as ten degrees away, twenty degrees away, and/or thirty degrees away), and the shapes and orientations of the various core structures 102 may be designed such that the cushion will provide a desirable cushioning effect along all such expected cushioning directions. In many embodiments of cushions, however, it is generally known that the cushioning direction will be at least primarily along a principle cushioning direction. For example, gravity will drive a person sitting on a flat horizontal seat cushion, laying on a flat horizontal mattress cushion, or standing on a relatively flat horizontal shoe sole cushion, into the cushion in a direction generally orthogonal to the major top cushioning surface of the cushion. If, for example, the core structures 102 of FIGS. 1A through 1C are to be part of a seat cushion, the column axis $L_{102}$ of the core structures 102 may be generally orthogonal to the major top cushioning surface of the cushion, especially when it is desirable for the core structures 102 to buckle at a threshold-buckling load.

The cushion 100 may be designed to cause the core structures 102 to buckle only under the higher pressure points (usually the most protruding areas) and be supported by the other areas without buckling by selecting particular combinations of the several variables affecting the threshold-buckling load, which may include the spacing between the core structures, the stiffness (i.e., elastic modulus) of the material of the core structures 102, the diameter of the core structures 102, the height (i.e., length along the axis $L_{102}$) of the core structures 102, the thickness of the wall 114 of the core structures 102, the durometer (i.e., elastomeric hardness) of the material or materials from which the core structures 102 are made, the expected weight of a body to be supported on, and cushioned by, the cushion 100, the expected surface area of the supported body in contact with the cushion 100, the shape, dimensions, and locations of the support material 104, the stiffness of the support material 104, the durometer of the support material 104, etc. Test data and practical testing and experience will allow various combinations of such variables to be selected so as to provide desirable threshold-buckling loads and other cushioning characteristics of the cushion 100 (e.g., displacement at buckling, etc.). Of course, cost is also an important consideration, and the cushioning characteristics of the cushion 100 may not be optimized from a performance perspective in favor of lowering the cost of the cushion 100 to consumers. For example, elastomeric gels are generally more expensive than polymeric foams, and, thus, it may be desirable to employ less gel to lower the cost of the cushion 100 than would otherwise be desirable if cushioning characteristics were to be optimized.

As shown in FIG. 1B, the support material 104 may fill the space between core structures 102. Support material 104 can optionally fill some or all of the interior spaces within the hollow, cylindrical core structures 102.

As shown in FIG. 1C, the top layer 106 may comprise a sheet of foam that is glued to the top major surface of the support material 104, and the bottom layer 108 may also comprise a sheet of foam that is glued to the bottom major surface of the support material 104. In additional embodiments, the bottom layer 108 may comprise a cotton tricot one-way stretch fabric that is heat fused to the bottom ends 112 of the core structures 102. Thus, after the core structures 102 have been inserted into corresponding apertures in the support material 104, the bottom major surface of the support material 104 may be glued to the fabric of the bottom layer 108. An additional fabric of the top layer 106 then may be provided over the top ends 110 of the core structures 102 (without fusing or otherwise adhering the additional fabric to the top ends 110), and may be glued to the top major surface of the support material 104. Such a configuration in which the top ends 110 and midsections of the core structures 102 are unconnected to any other element of the cushion 100 may allow the core structures 102 to freely buckle under a load, while restraining the bottom ends 112 of the core structures 102 such that the core structures 102 cannot turn over within their corresponding apertures in the support material 104. The stretchable nature of the fabric may ensure that it will not overly interfere with the ability of the core structures 102 and the support material 104 to deform.

In additional embodiments, the bottom ends 112 of the core structures 102 may be heat-fused to a cotton tricot one-way stretch fabric glued to the top surface of the foam of the bottom layer 108. The support material 104 then may be provided around the core structures, after which another such fabric of the top layer 106 may be heat-fused to the top ends 110 of the core structures 102. In addition to heat-fusing the core structures 102 to the fabrics, the support material 104 may be glued to the fabrics. If the top layer 106 and the bottom layer 108 include a layer of foam, such layers of foam also may be glued to the support material 104 over, through, or around the fabrics, or may be glued to the fabrics.

Figure 2A:
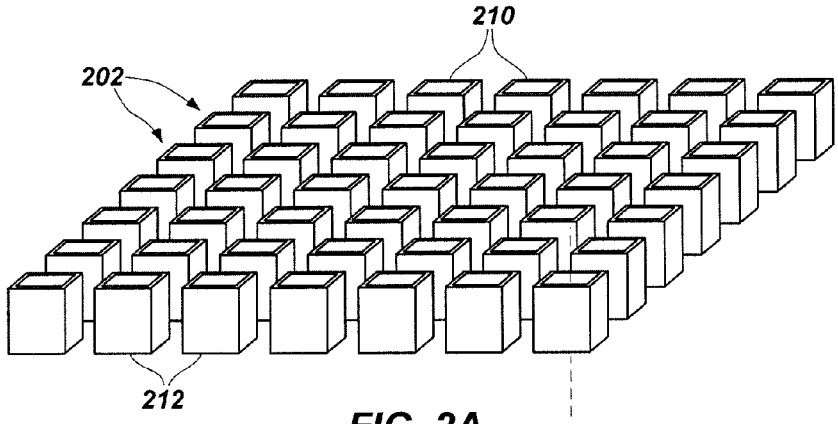
FIGS. 2A through 2C illustrate another embodiment of a cushion of the present invention that includes hollow, rectangular core structures of a first material disposed within a surrounding medium comprising a different material.
Figure 2B:
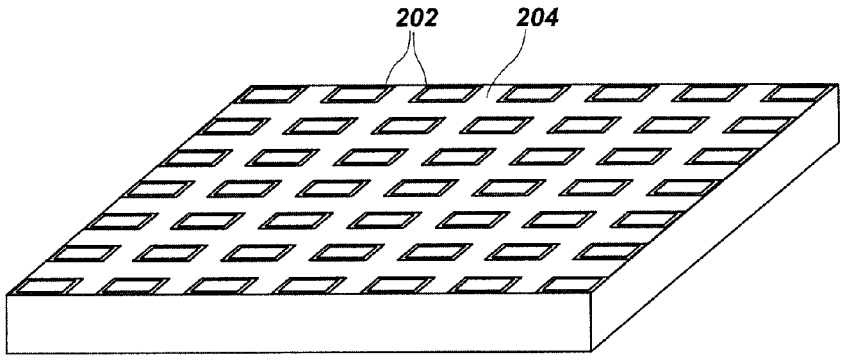
Figure 2C:
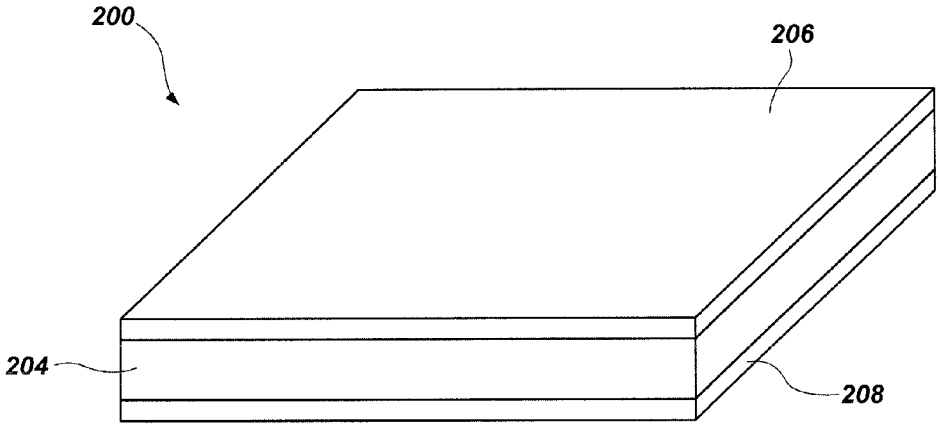

Another embodiment of a cushion 200 of the invention is shown in FIGS. 2A through 2C. The cushion 200 is similar to the cushion 100 of FIGS. 1A through 1C, except that the core structures 202 of the cushion 200 comprise hollow structures having a rectangular (e.g., square) cross-sectional shape. The complete cushion 200 is shown in FIG. 2C. The cushion 200 includes a plurality of core structures 202, which are shown isolated from other features of the cushion 200 in FIG. 2A. As shown in FIG. 2B, the core structures 202 are disposed within and surrounded by a support material 204 comprising a material that differs from that of the core structures 202. As shown in FIG. 2C, the cushion 200 may further comprise at least one of a top layer 206 and a bottom layer 208 disposed over the top ends 210 and the bottom ends 212 (FIG. 2A) of the core structures 202. The core structures 202 and support material 204 may comprise any of the materials discussed herein in relation to the core structures 102 and the support material 104, respectively, and may have any of the configurations discussed herein in relation to the core structures 102 and the support material 104, respectively.

Figure 3A:
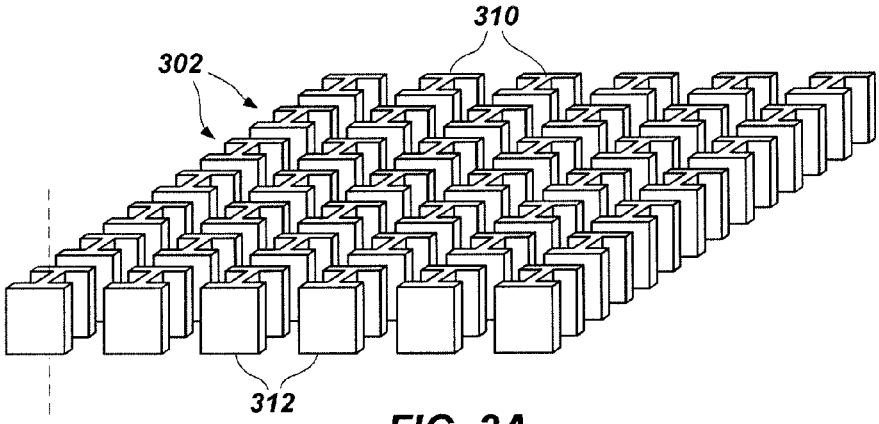
FIGS. 3A through 3C illustrate another embodiment of a cushion of the present invention that includes I-shaped core structures of a first material disposed within a surrounding medium comprising a different material.
Figure 3B:
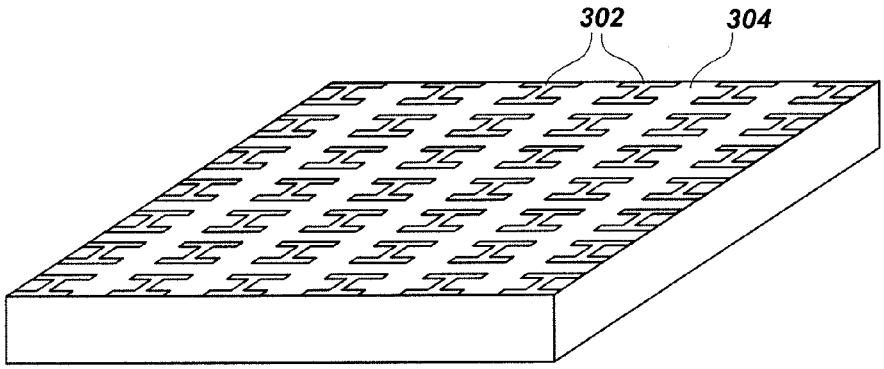
Figure 3C:
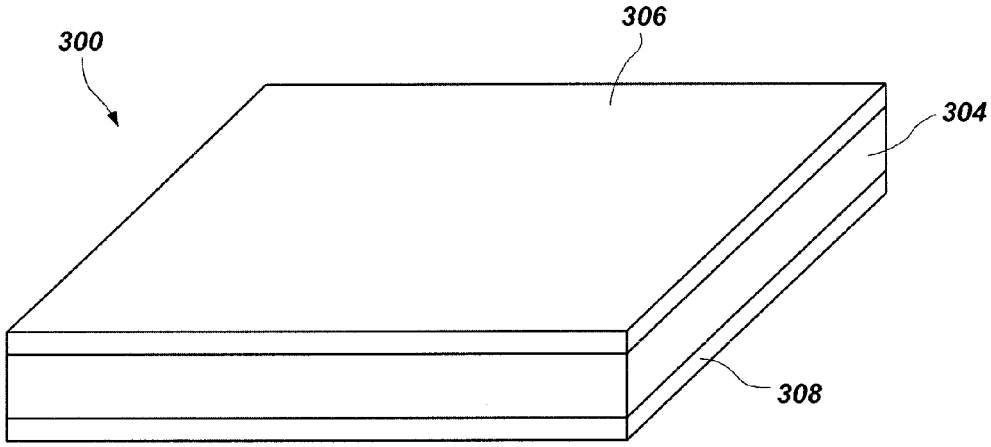

Yet another embodiment of a cushion 300 of the invention in shown in FIGS. 3A through 3C. The cushion 300 is similar to the cushion 100 of FIGS. 1A through 1C, except that the core structures 302 of the cushion 300 comprise solid (non-hollow) structures that have an "I-beam" cross sectional shape. The complete cushion 300 is shown in FIG. 3C. The cushion 300 includes a plurality of core structures 302, which are shown isolated from other features of the cushion 300 in FIG. 3A. As shown in FIG. 3B, the core structures 302 are disposed within and surrounded by a support material 304 comprising a material that differs from that of the core structures 302. As shown in FIG. 3C, the cushion 300 may further comprise at least one of a top layer 306 and a bottom layer 308 disposed over the top ends 310 and the bottom ends 312 (FIG. 3A) of the core structures 302. The core structures 302 and support material 304 may comprise any of the materials discussed herein in relation to the core structures 102 and the support material 104, respectively, and may have any of the configurations discussed herein in relation to the core structures 102 and the support material 104, respectively.

In the embodiment shown in FIGS. 3A through 3C, the support material 304 at least substantially fills the space between the core structures 302. In additional embodiments, the support material 304 may be designed configured such that it does not fill spaces on one or both sides of the central beam member between the two end beam members of each core structure 302. In other words, apertures may be provided in the support material 304 that have a generally rectangular cross-sectional shape (like those of the support material 204 of FIG. 2B), and the I-beam shaped core structures 302 may be inserted into the rectangular apertures of the support material 304. Such a configuration may allow the core structures 302 to more freely buckle. The core structures 302 shown in FIGS. 3A and 3B may buckle even in embodiments in which the support material 304 fills the entire space laterally surrounding the core structures 302, provided that the material (e.g., foam) of the support material 304 is soft enough relative to that of the core structures 302 to allow the buckling of the core structures 302 to occur.

Figure 4A:
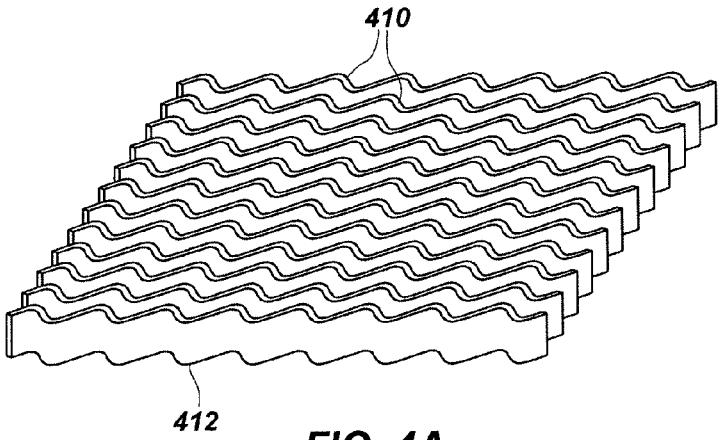
FIGS. 4A through 4C illustrate another embodiment of a cushion of the present invention that includes elongated, laterally extending and undulating core structures of a first material disposed within a surrounding medium comprising a different material.
Figure 4B:
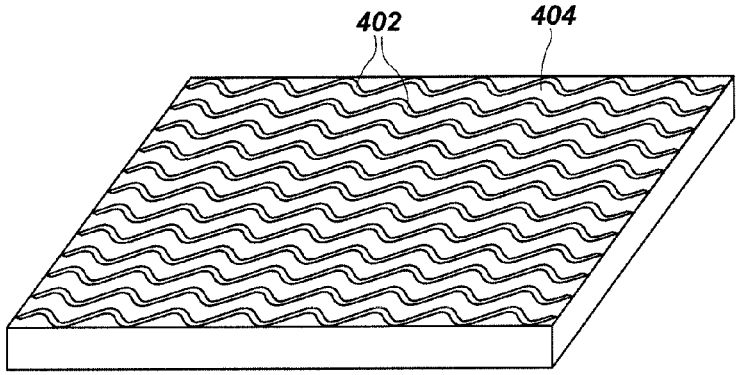
Figure 4C:
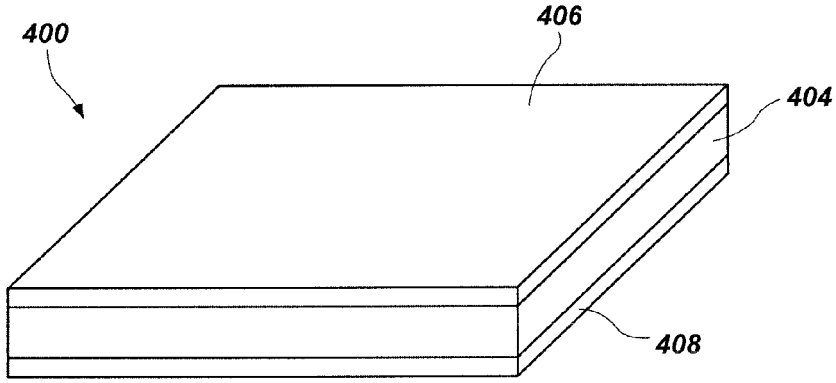

Another embodiment of a cushion 400 of the invention is shown in FIGS. 4A through 4C. The cushion 400 is similar to the cushion 100 of FIGS. 1A through 1C, except that the core structures 402 of the cushion 400 comprise solid (non-hollow) laterally elongated and undulating bars (e.g., having a shape similar to that of a sine wave) that extend laterally through a support material 404. The complete cushion 400 is shown in FIG. 4C. The cushion 400 includes a plurality of core structures 402, which are shown isolated from other features of the cushion 400 in FIG. 4A. As shown in FIG. 4B, the core structures 402 are disposed within and surrounded by a support material 404 comprising a material that differs from that of the core structures 402. As shown in FIG. 4C, the cushion 400 may further comprise at least one of a top layer 406 and a bottom layer 408 disposed over the top ends 410 and the bottom ends 412 (FIG. 4A) of the core structures 402. The core structures 402 and support material 404 may comprise any of the materials discussed herein in relation to the core structures 102 and the support material 104, respectively, and may have any of the configurations discussed in relation to the core structures 102 and the support material 104, respectively.

The undulating structure of the core structures 402 gives each core structure 402 some added stability of its own (relative to an elongated and laterally extending straight (i.e., non-undulating) bar) in addition to that provided by the surrounding support material 404.

In the embodiment shown in FIGS. 4A through 4C, the support material 404 at least substantially fills the space between the core structures 402. In additional embodiments, the support material 404 may be designed configured such that it does not fill spaces in the valleys of the undulating (e.g., sine wave) structure on one or both sides of each core structure 402. In other words, elongated, straight bar-shaped apertures may be provided in the support material 404 that have a generally rectangular cross-sectional shape, and the undulated core structures 402 may be inserted into the elongated, rectangular apertures of the support material 404. Such a configuration may allow the core structures 402 to more freely buckle. The core structures 402 shown in FIGS. 4A and 4B may buckle even in embodiments in which the support material 404 fills the entire space laterally surrounding the core structures 402, provided that the material (e.g., foam) of the support material 404 is soft enough, relative to that of the core structures 402 to allow the buckling of the core structures 402 to occur.

Figure 5:
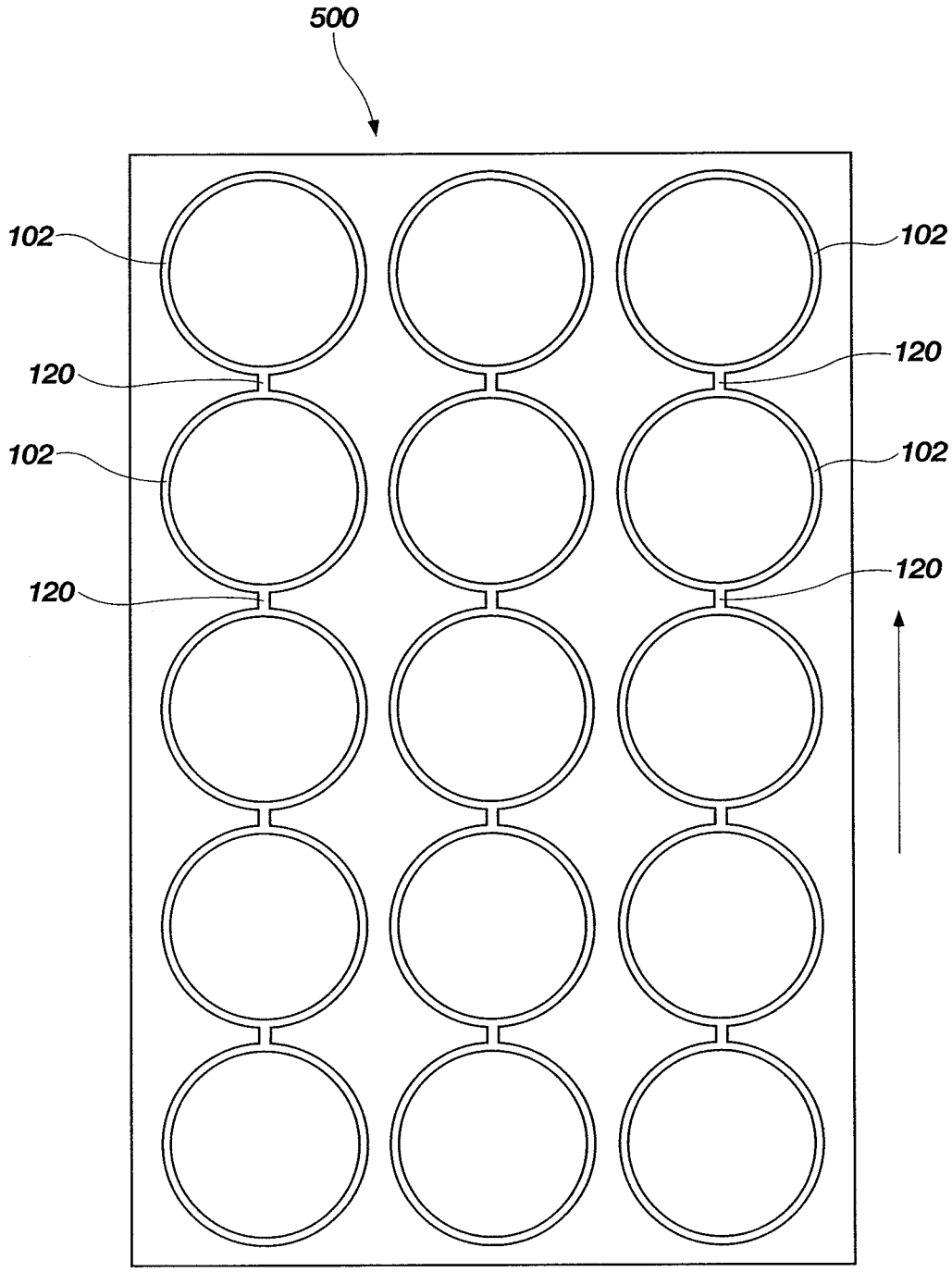
FIG. 5 illustrates fabrication of core structures like those of FIGS. 1A through 1C, but including joining ribs, using a screed molding process.
Figure 6A:
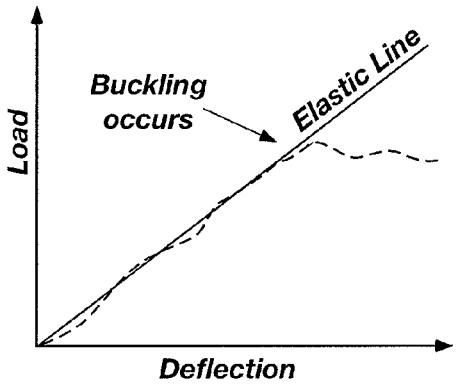
FIGS. 6A through 6D illustrate example, representative load versus deflection curves that may be exhibited by embodiments of core structures of the present invention when subjected to compressive loading while measuring the load as a function of deflection.
Figure 6B:
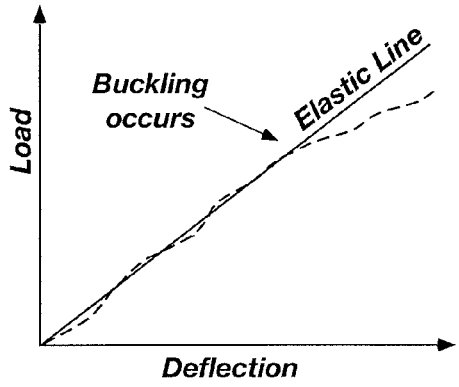
Figure 6C:
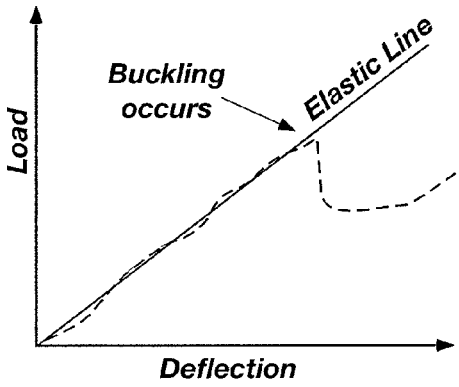
Figure 6D:
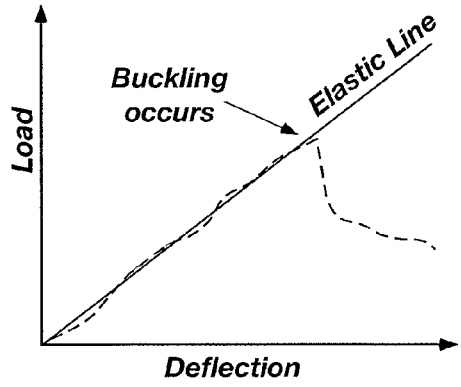

Referring to FIG. 5, which illustrates fabrication of core structures 102 similar to those of FIGS. 1A through 1C (as discussed in further detail below), in some embodiments, joiner ribs 120 may be provided between core structures 102 in a cushion 100 (FIG. 1C). For example, a cushion 100 may include a plurality of rows (e.g., lines) of core structures 102, and joiner ribs 120 may be provided between core structures 102 in each row, respectively, as shown in FIG. 5. In some embodiments, each row of core structures 102 that are interconnected with one another by joiner ribs 120 may not be connected to an adjacent row of interconnected core structures 102. In other embodiments, however, each row of core structures 102 that are interconnected with one another by joiner ribs 120 may also be connected to an adjacent row of interconnected core structures 102. Such joiner ribs 120 may be formed between the core structures 102 as they are manufactured. When the core structures 102 comprise a gel material, such joiner ribs 120 may not affect the function of the core structures 102 in any significant manner. The joiner ribs 120 may be made of the same material as the core structures 102, and may be integrally formed therewith. The joiner ribs 120 may have any shape and size, and may extend vertically from the top ends 110 to the bottom ends 112 of the core structures 102, or they may extend only along a portion of the length of the core structures 102.

The joiner ribs 120, when used in conjunction with a screed mold manufacturing process (as discussed in further detail below), may allow multiple core structures 102 to be pulled out from a mold without the need of having a skin on the top of the mold. The joiner ribs 120 may also allow multiple core structures 102 to be placed into one or more fixtures preparatory to bonding (e.g., heat-fusing) a material (e.g., fabric) to the top ends 110 and/or the bottom ends 112 of the core structures 102. Optionally, the joiner ribs 120 may be severed and/or completely removed from the core structures 102 before use of the core structures 102 in a cushion 100. In such instances, the advantage of easy removal of the core structures 102 from a mold may be utilized, and the presence of severed joiner ribs 120 on the core structures 102 may have little or no affect on the cushioning characteristics of the cushion 100.

A non-limiting example embodiment of a mattress comprising core structures 102 like those illustrated in FIGS. 1A and 1B, and that includes seven layers and a cover, is as follows, beginning with the bottom layer and adding layers on top successively: p Layer 1: A fifteen centimeter (15 cm) (about six inches) thick layer of conventional polyurethane foam having an indentation load deflection (ILD) rating of twenty-seven (27 ILD) and a density of about 0.03 g/cm$^3$ (about 1.8 lb/ft$^3$), which is commercially available from FXI Foamex Innovations of Media, Pa. This layer corresponds to the bottom layer 108 of FIGS. 1A through 1C.

Layer 2: A water-based adhesive commercially available under the product name SIMALFA® 309 from Alfa Adhesives, Inc. of Hawthorne, N.J., which is used to bond Layer 1 to Layer 3.

Layer 3: Cotton tricot, stretchable in at least one direction available from Culp, Inc. of High Point, N.C., in a number of fabric weights.

Layer 4: A water-based adhesive commercially available under the product name SIMALFA® 309 from Alfa Adhesives, Inc. of Hawthorne, N.J., which is used to bond Layer 3 to Layer 5.

Layer 5: A layer including hollow, cylindrical gel-core structures (with joiner ribs in one direction as described below with reference to FIG. 5) that are about five centimeters (5 cm) (about two inches) tall, about three and eight-tenths of a centimeters (3.8 cm) (about one and a half inches) in diameter, and having a wall thickness (in the cylindrical gel-core structures and the joiner ribs) of about twenty-five hundredths of a centimeter (0.25 cm) (about one-tenth of an inch). The gel of the hollow, cylindrical gel-core structures (and joiner ribs) comprises 2.5 parts CARNATION® oil to one part KRATON® E1830 (which is a styrene-ethylene-butylene-styrene (SEBS) tri-block copolymer elastomer in which the ethylene-butylene (EB) mid-blocks of the copolymer molecules have a relatively wide range of relatively high-molecular weights, and which is commercially available from Kraton Polymers U.S. LLC of Houston, Tex.), 0.01% by weight blue pigment, 0.1% by weight antioxidants in a 50/50 blend of CIBA IRGAFOS® 168 and CIBA IRGANNOX® 1010 (which are commercially available from Ciba Specialty Chemicals Inc., which is now part of BASF Corporation of Florham Park, N.J.). The space between the strings of cylindrical gel-core structures is filled with a support material comprising 19 ILD Talalay latex foam rubber commercially available from Latex International of Shelton, Conn. The latex foam rubber is about five centimeters (5.0 cm) (about two inches) thick, and is not bonded to the hollow, cylindrical gel-core structures. The hollow, cylindrical gel-core structures and joiner ribs are heat-fused to the cotton tricot of Layer 3. The interior of the hollow, cylindrical gel-core structures is empty (filled with air at atmospheric pressure). The latex foam rubber support material of Layer 5 is bonded to the cotton tricot of Layer 3 with the adhesive of Layer 4.

Layer 6: A water-based adhesive commercially available under the product name SIMALFA® 309 from Alfa Adhesives, Inc. of Hawthorne, N.J., which is used to bond the latex foam rubber of Layer 5 to the latex foam rubber of Layer 7.

Layer 7: A two and a half centimeters (2.5 cm) (about one inch) thick layer of 19 ILD Talalay latex foam rubber commercially available from Latex International of Shelton, CT. This layer corresponds to the top layer 106 of FIG. 1C.

Cover: A standard quilted cover is well-known in the mattress industry. Alternatively, a non-quilted stretch cover, such as is common for memory foam beds, such as TEMPUR-PEDIC® brand memory foam beds sold by Tempur-Pedic, Inc. of Lexington, Ky.

Another non-limiting example embodiment of a mattress comprising core structures 202 like those illustrated in FIGS. 2A and 2B, and that includes four layers and a cover, is as follows, beginning with the bottom layer and adding layers on top successively:

Layer 1: A fully foam-encased layer of pocket metal coil springs of the type that is well-known in the mattress industry. This layer may have a thickness of about twelve and seven-tenths of a centimeter (12.7 cm) (about eight inches).

Layer 2: A water-based adhesive commercially available under the product name SIMALFA® 309 from Alfa Adhesives, Inc. of Hawthorne, N.J., which is used to bond Layer 1 to the memory foam portion of Layer 3.

Layer 3: A cushion 200 as previously disclosed in relation to FIGS. 2A through 2C, wherein the core structures 202 are about five centimeters (5 cm) (about two inches) tall, about three and eight-tenths of a centimeter (3.8 cm) (about 1.5 inches) in width, and have a wall thickness (in the gel-core structures) of about twenty-five hundredths of a centimeter (0.25 cm) (about one-tenth of an inch). The gel of the hollow gel-core structures comprises 2.5 parts CARNATION® oil to one part KRATON® E1830, 0.01% by weight blue pigment, 0.1% by weight antioxidants in a 50/50 blend of CIBA IRGAFOS® 168 and CIBA IRGANNOX® 1010 (which are commercially available from Ciba Specialty Chemicals Inc., which is now part of BASF Corporation of Florham Park, N.J.). The space between the gel-core structures and within the interior of the gel-core structures is filled with a support material comprising a viscoelastic polyurethane memory foam having a density of about 0.08 g/cm$^3$ (about 5.3 lb/ft$^3$), such as those commercially available from FXI Foamex Innovations of Media, Pa. Optionally, the cushion may also include a top layer 108 and a bottom layer 108, which also may comprise such a viscoelastic polyurethane memory foam.

Layer 4: A water-based adhesive commercially available under the product name SIMALFA® 309 from Alfa Adhesives, Inc. of Hawthorne, N.J., which is used to bond the cover to the assembly that includes Layers 1 through 3.

Cover: A standard quilted cover is well-known in the mattress industry. Alternatively, a non-quilted stretch cover, such as is common for memory foam beds, such as TEMPUR-PEDIC® brand memory foam beds sold by Tempur-Pedic, Inc. of Lexington, Ky.

As previously mentioned, the core structures of cushions of the invention may comprise (e.g., may be formed from) a gel. Gel-core structures have a "feel" that is desirable in many types of cushions, such as mattresses, seat cushions, shoe insoles, and the like. Gel is able to buckle with more agility than relatively stiffer elastomers, and sometimes exhibit multiple curves in the load versus deflection plot during buckling. A relatively stiffer elastomer may simply fold and, thus, not exhibit a gradual buckling event, or may not buckle under typical cushioning pressures when manufactured at reasonable wall thicknesses. Gel also provides cushioning without buckling, due to its ability to flow and conform in shape around a cushioned object. Thus, if the cushioned object "bottoms out," the resultant pressure peak on the cushioned object may be less if the cushion comprises gel rather than a relatively harder elastomer. Although gels may be used in some embodiments, non-gel elastomers and/or higher-durometer elastomers, such as cross-linked latex rubber or cross-linked and non-cross-linked synthetic elastomers of many types (e.g., SANTOPRENE®, KRATON®, SEPTON®, isoprene, butadiene, silicone rubber, thermoset or thermoplastic polyurethane, etc.) may also be used.

There are numerous types of gels that may be used to form core structures, as described herein, including plasticized silicone gels, plasticized polyurethane gels, plasticized acrylic gels, plasticized block copolymer elastomer gels, and others. Plasticized block copolymer gels may be relatively less tacky and less susceptible to bleed or wicking out of the plasticizer relative to some other types of gels. Plasticized block copolymer gels also may exhibit greater tensile, compression, shear and/or tear strengths relative to some other types of gels, and may not exhibit permanent deformation after being repeatedly stressed or stressed continuously for a long period of type under conditions to which cushions for cushioning at least a portion of a body of a person may be subjected.

Three non-limiting examples of gels that may be used to form core structures, as described herein, are provided below.

EXAMPLE 1

A gel may be formed by melt blending SEPTON® 4055, which is a relatively high-molecular weight Styrene-Ethylene-Ethylene-Propylene-Styrene (SEEPS) tri-block copolymer elastomer, with white paraffinic mineral oil with no or low aromatic content, such as CARNATION® oil. The durometer of the gel can be adjusted as desirable (for example, to tailor the buckling pressure threshold for a given application) by adjusting the ratio of SEEPS to oil. A higher ratio will result in a higher durometer gel. By way of non-limiting example, in some embodiments, the gel may include between 150 and 800 parts by weight of mineral oil to 100 parts by weight SEPTON® 4055. In some embodiments, cushions such as mattresses and seat cushions may include between 250 and 500 parts by weight mineral oil to 100 parts by weight SEPTON® 4055.

The gel can also be stiffened by adding a stiffness reinforcer. For example, a filler material, such as microspheres, may be incorporated into the gel as described in U.S. Pat. No. 5,994,450, which has been incorporated herein by reference.

EXAMPLE 2

A gel may be formed by melt blending KRATON® E1830, which is a Styrene-Ethylene-Butylene-Styrene (SEBS) tri-block copolymer elastomer in which the EB mid-blocks of the copolymer molecules have a relatively wide range of relatively high-molecular weights, with white paraffinic mineral oil with no or low aromatic content, such as CARNATION® oil. As in Example 1, the durometer of the gel can be adjusted as desirable by adjusting the ratio of SEBS to oil. A higher ratio will result in a higher durometer gel. By way of non-limiting example, in some embodiments, the gel may include between 100 and 700 parts by weight of mineral oil to 100 parts by weight KRATON® E1830. In some embodiments, cushions such as mattresses and seat cushions may include between 150 and 450 parts by weight mineral oil to 100 parts by weight KRATON® E1830.

The gel can also be stiffened by adding a stiffness reinforcer. For example, a filler material, such as microspheres, may be incorporated into the gel as described in U.S. Patent Application Publication No. US 2006/0194925 A1, which published Aug. 31, 2006, now U.S. Pat. No. 7,964,664, issued Jun. 21, 2011, and is entitled "Gel with Wide Distribution of MW in Mid-Block," which is incorporated herein in its entirety by this reference.

EXAMPLE 3

A gel may be formed by melt blending a mixture of KRATON® E1830 and SEPTON® 4055, with white paraffinic mineral oil with no or low aromatic content, such as CARNATION® oil. As in Examples 1 and 2, the durometer of the gel can be adjusted as desirable by adjusting the ratio of the polymer mixture to oil. A higher ratio will result in a higher durometer gel. By way of non-limiting example, in some embodiments, the gel may include between 100 and 700 parts by weight of mineral oil to 100 parts by weight of the polymer mixture. Furthermore, the gel may be stiffened as described in relation to Examples 1 and 2.

In any of the examples provided above (or in any other embodiment of the invention), all or part of the plasticizer (e.g., mineral oil) may be replaced with a resin that is solid or liquid at a temperature at which a cushion including the gel is to be used, such as, for example, a hydrogenated pure monomer hydrocarbon resin sold under the product name REGALREZ® by Eastman Chemical Company of Kingsport, Tenn. Use of an ultra-viscous resin may cause the resultant gel to have a relatively slow rebound, which may be desirable for some cushioning applications. Many such resins are commercially available, and REGALREZ® is merely provided as a suitable, non-limiting example. Hollow glass or plastic microspheres may be added to these slow rebound gels to lower the density and/or to increase the durometer.

For example, if 1600 parts of REGALREZ® 1018 is used as the plasticizer with 100 parts of SEPTON® 4055, the resulting gel may be relatively soft and exhibit slow-rebound characteristics at room temperature. REGALREZ® 1018 is a highly viscous fluid at room temperature. Alternatively, in similar embodiments, REGALREZ® 1018 may be replaced with a mixture of mineral oil and any of the REGALREZ® products that are solid (usually sold in chip form) at room temperature. Such a slow-rebound gel that is plasticized using a blend of mineral oil and resin that is solid at room temperature may exhibit less temperature-related changes in durometer and rebound rate over temperatures comfortable to people than will a gel that includes REGALREZ® 1018 as a sole plasticizer, which has a viscosity that changes with temperature over the range of temperatures comfortable to people (e.g., temperatures near room temperature).

Slow-rebound gels that are plasticized with resin may be may be relatively tacky or sticky relative to other gels. In such cases, when the gel-core structures buckle and one part of a core structure touches another part of the core structure, they may have a tendency to stick together and not release when the cushioned object is removed. In an effort to reduce or eliminate such occurrences, a surface of the gel-core structures may be coated with a material that will stick to the gel, but that is not itself sticky. For example, a surface of the gel-core structures may be coated with one or more of microspheres and Rayon (velvet) flocking fibers. For example, microspheres may adhere relatively well to the surface of gel-core structures and not easily come off Thus, the surface of the gel material may be rendered less tacky or un-tacky because the outer surface now comprises the outer surfaces of millions of non-tacky microspheres. As another example, tiny Rayon (velvet) flocking fibers also may adhere relatively well to the surface of the gel-core structures and not easily come off Thus, the surface of the gel material may be rendered less tacky or un-tacky because the outer surface now comprises the outer surface of thousands of non-tacky short fibers. A third example is to put a thin layer (e.g., skin) of polyurethane elastomer over the gel material, either by application of a thermoplastic polyurethane film, or by coating the gel in an aqueous dispersion of polyurethane and allowing it to dry, or by other methods. The stickiness may be desirable in some embodiments, and, if so, covering may not be done. For example, the outer surface of a core structure may desirably adhere to the support structure. As a further example, in the non-hollow core structure embodiments described herein, the entire surface of a core structure may desirably adhere to the support structure and to the top and bottom foam lids.

Gel-core structures made with a relatively slow-rebound elastomer may have a different feel than gel-core structures made with other gels that exhibit a relatively faster rebound rate. Such slow-rebound gel-core structures may be used in conjunction with a surrounding support material comprising a memory foam in a mattress or seat cushion, since memory foam also exhibits relatively slow rebound rates.

Embodiments of core structures (e.g., gel-core structures) as described herein above may be manufactured using any process that can create core structures of any desirable configuration and any desirable material composition. The following manufacturing methods are provided as non-limiting examples:

In embodiments in which the core structures comprise a thermoplastic material (e.g., a thermoplastic gel), they may be manufactured using an injection molding process. A mold is made by means known in the art with cavities that are filled by any standard injection molding process. The material is cooled within the mold cavity, the mold is opened, and the fabricated part is ejected from or pulled out of the mold. A gel material of a molded part may conform to ejector pins used to eject the molded part out from the mold cavity as the pins are thrust into the mold cavity to eject the part, such that the part may not be properly ejected from the mold cavity. Thus, the injection molds may not include such ejector pins, and the mold operator may manually pull out the molded gel products from the mold cavity. One advantage to injection molding gel-core structures is that, when the molded gel-core structures are pulled on by a mold operator, the Poisson's effect may temporarily significantly reduce the cross-sectional thickness of the molded gel-core structures, and, as a result, the molded gel-core structures may pull out from the mold cavity without the need for a draft angle on the cavity surfaces, and may even be removed if the mold cavity includes undercut regions in some cases. In embodiments that comprise a gel that when melted or before curing is sufficiently non-viscous to pour, the gel can be poured into the cavities in the support structure, then allowed to cool (if the gel is a thermoplastic material) or to cure (if the gel is a thermoset material).

In additional embodiments of the invention, core structures as described herein may be manufactured using an extrusion process. For example, each gel-core structure of a cushion may be separately extruded using extrusion processes known in the art. For example, molten material may be forced through an aperture in a die using a rotating, stationary screw in a barrel (e.g., an extruder). The die aperture may have the desired cross-sectional shape of the core structure to be formed. The extruding material may be cut-off or severed at intervals corresponding to the desired lengths of the core structures, and the extruded core structures may be cooled. The core structures then may be arranged in a desired pattern for the cushion to be formed, and foam or another support material may be placed around (and, optionally, within) the core structures. The die used in such an extrusion process may be relatively small, as it may correspond in size to only a single core structure, which may be desirable relative to processes that require tooling having a size comparable to that of the entire cushion being formed. Thus, embodiments of core structures as disclosed herein may be manufactured using tooling and equipment that is relatively smaller, less complicated, and less expensive compared to tooling and equipment used to form previously known gel or buckling gel cushions.

In situations in which the equipment and/or tooling cost is not as important as other considerations, such as having an integral skin or where volume of production is such that the equipment and tooling cost is amortized over a very large number of parts and thus becomes inconsequential), an open-faced pressure-screeding system may be used to manufacture core structures in accordance with additional embodiments of the present invention. Such methods are disclosed in, for example, U.S. Pat. No. 7,666,341, which issued Feb. 23, 2010 to Pearce, and which is incorporated herein in its entirety by this reference. Such a process is briefly disclosed below.

A screed mold may be formed or otherwise obtained that has a rigid body. The screed mold comprises an open-faced mold, and has multiple recesses in the rigid body that define cavities of the screed mold, such that gel or another material may be forced into the cavities of the mold to form core structures of a desirable shape. The screed mold optionally may have a raised lip around a periphery of the mold, which allows for a sheet of gel or other material to form at the top of the screed mold over the face, which sheet will be integral with the core structures formed in the cavities of the mold. In additional embodiments, the screed mold may not include such a raised lip, such that the gel or other material may be screeded flush or nearly flush with the top surface of the open face of the mold by a screed head used to inject the gel or other material into the cavities, or by another tool, with any excess being scraped off after that portion of the mold exits the screed head.

An injection head then may be used to inject gel or other material into the mold cavities. The injection head may have a plurality of distribution channels therein through which molten gel or other material may flow. The distribution channels optionally may be subdivided into sub-distribution channels, and the distribution or sub-distribution channels may terminate at exit ports through which molten gel exits the injection head and enters the screed mold. The injection head also may include at least one external or internal heating element for heating the injection head.

The injection head may be positioned adjacent the screed mold in a location and orientation such that molten gel may flow from the injection head distribution channels out of the exit ports and into the cavities of the screed mold and, optionally, into a skin-forming recess of the mold.

A pumping source may be utilized to pressurize and pump the gel or other material and force it into the injection head, through the distribution channels of the injection head, out of the exit ports of the injection head, and into the screed mold. Relative movement may be provided between the injection head and the screed mold during the injection process, such that the injection head fills the mold cavities and screeds molten gel or other material off from the open face of the mold in a progressive manner.

The gel or other material may be cooled and solidified within the cavities of the mold, after which the molded gel or other material may be removed from the cavities of the screed mold. Thus, core structure having a desired geometric shape may be formed, and may be formed with or without an integral skin layer.

An integral skin layer may allow the molded structure comprising a plurality of core structures to be lifted out from the mold in a single piece, since they are all connected by the skin layer. Additionally, the integral skin layer may maintain the core structures properly positioned relative to one another. However, if no integral skin layer is desired, the screed mold side lips may be omitted and the screed mold may be automatically or manually scraped off at the top of each core structure during or after the molding process. Then, to avoid the necessity of removing each member individually, a fabric may be pressed into the molten gel or other material. If the material has solidified within the mold, end portions of the core structures may be heated to a temperature sufficient to re-melt the end portions of the core structures prior to pressing the fabric into the end portions of the core structures. The core structures then may be cooled, and the assembly comprising the fabric and the core structures attached thereto may be pulled out of the mold. Other methods may also be used to aid in removal of core structures from the mold cavities together, or each core structure may simply be individually pulled out from the mold.

In additional embodiments, a partial skin layer may be integrally formed over one or both sides of the core structures to connect the core members together, so as to improve the breathability of the resulting cushion. This may be done by, for example, configuring an open-faced screed mold with areas which, when screeded and/or scraped, form holes through the skin without removing the entire skin. The holes can be between core structures or located over an interior space of a hollow core structure.

In additional embodiments of the invention, the core structures may include joiner ribs, as previously described herein, such that an entire row or line of core structures may be pulled out from the mold together. FIG. 5 shows a screed mold 500 that is configured to form an array of core structures 102 that includes three rows or lines of core structures 102 (shown extending vertically in FIG. 5). The screed mold 500 is also configured to form joiner ribs 120 between the core structures 102 in each respective row of core structures 102. Thus, as a single core structure 102 is removed from the screed mold 500 and continued to be moved away from the screed mold 500, the joiner rib 120 would then pull out the adjacent core structure 102, and then the next joiner rib 120 would pull out the next core structure 102, and so on. In some embodiments, a slot for a joiner rib 120 may be provided at the ends of the mold 500 corresponding to the ends of the rows of core structures 102, such that successive molds 500 can be sequentially passed through the screed system and the joiner rib 120 connected to the last core structure 102 of one mold 500 would be integral and continuous with the first core structure 102 of the succeeding mold 500, and would thus pull out the first core structure 102 of the succeeding mold 500. In such embodiments, the screed molding process may be operated continuously once it is started. Several molds 500 may be used, and each can be returned from the end of the screed molding system to the front end of the screed molding system after the molded core structures 102 are removed from the mold 500. Several rows or lines of core structures 102 with joiner ribs 120 may be pulled out simultaneously. For example, in the embodiment of FIG. 5, all three lines of core structures 102 may be pulled out from the mold 500 simultaneously.

If desired, a fabric may be fused into the tops and/or bottoms of the core structures, as described above. When joiner ribs are used, it may be easier and require less labor to locate a joined line of core structures into a heat-fusing fixture than to locate each of a plurality of un-joined core structures into such a fixture. Fabric may be fused into the ends of core structures by placing the core structures in their desired spacing and orientation, then placing the fabric over the top and smoothing out any wrinkles in the fabric. A heated platen then may be brought into contact with the fabric and the underlying ends of the core structures. The temperature of the heated platen may be such that the gel or other material will melt, but not burn or otherwise degrade. The heated platen may be part of a press device, which may have a mechanical stop at a predetermined distance below the plane at the top of the fabric. For example, the heated platen may be stopped at a predetermined distance below the plane at the top of the fabric upon closing the press that is at least half the thickness of the fabric. After a period of time sufficient to melt the gel or other material, and to allow the gel to flow into the external and/or internal interstices of the fabric, the platen may be raised, and the gel or other material may be allowed to cool and solidify. The assembly then may be removed from the press. This process optionally may be performed on the opposite side of the assembly after putting the foam or other support material around (and, optionally, within) the core structures, or the support material may be introduced into the spaces around the core structures from the lateral sides of the assembly (for example, by working multiple pieces of foam into the assembly) after fusing fabric to both the top and bottom ends of the core structures. In additional embodiments, core structures (with or without the support material there around) may be oriented between two pieces of fabric, and the assembly may be pulled through a pair of opposing heated platens to simultaneously fuse the top and bottom fabrics to the tops and bottoms of the core structures, respectively. Such a process may be continuously operated. The fabric may be supplied by rolls of fabric, and the core structures may be placed between the fabrics continuously.

Embodiments of cushions of the present invention may include a cover, which may be bonded or unbonded to the interior cushioning member of the cushion. For example, a cover may simply be slipped over the interior cushioning member, and, optionally, may be closed using, for example, a zipper or hook-and-loop material. In embodiments of furniture cushions, the cover may comprise an upholstery fabric, leather, etc. In embodiments of wheelchair cushions, the cover may comprise a stretchable, breathable, waterproof fabric, such as a spandex-type knitted material laminated to a thin polyurethane film.

Any of the cushions shown in FIGS. 1A-1C, FIGS. 2A-2C, FIGS. 3A-3C, and FIGS. 4A-4C may be configured as a furniture cushion, a wheelchair cushion, or any other type of cushion.

Embodiments of core structures as described herein may be used in an unlimited number of cushioning applications. Core structures may be designed to buckle at a predetermined threshold pressure level, and this buckling may relieve pressure hot spots and redistribute pressure so that no part of the cushioned object receives pressure above the predetermined threshold pressure level. In addition, the ability of the individual core structures to deform laterally relative to the direction of the principal cushioning load may relieve shear stresses on the cushioned object. Further, the nature of most elastomers and especially plasticized elastomers, such as gel, is to absorb shock and attenuate vibration, which, when combined with the shock absorption and vibration attenuation that is provided by buckling action of the core structure, may provide further improved shock absorption and vibration attenuation characteristics in accordance with some embodiments of cushions of the invention. Any cushioning application needing any or all of these characteristics may benefit by utilizing supported core structures as described herein. It would be impossible to list all such cushioning applications; however, a few applications include consumer and medical mattresses, consumer and medical mattress overlays, pillows for the head, seat cushions, neck cushions, knee pads, shoe insoles, shoe sock liners, shoe midsoles, shoe outsoles, orthopedic braces, wheelchair positioners and cushions, surgical positioners, heel pressure relievers for invalids, crib mattresses, crib pads, diaper changing pads, pet beds, pet pads, bicycle seats, bicycle seat overlays, seat overlays or seats for cars, motorcycles, recreational vehicles (RVs,) semi-trucks, heavy equipment and farm tractors, gymnastic pads, yoga pads, aerobic pads, exercise benches, boxing gloves, sports impact padding, helmets, aircraft seats, furniture for the home including sofas, recliners, love seats and chairs, furniture for the office including office chairs, patio furniture, hunting pads, baby carrier straps, infant car seats, backpack straps, backpack scapula pads and backpack and fanny pack waistbands.

The word "unitary" when used to describe the support structure herein can mean a single structure or can mean a structure made by joining (for example, by adhesively joining polyurethane foam or latex foam rubber) originally separate pieces.

Additional non-limiting examples of embodiments are set forth below.

Embodiment 1: A cushion, comprising: a plurality of core structures, each core structure of the plurality of core structures comprising a first deformable polymer material, each core structure of the plurality of core structures configured as a column having a column axis; and a support material at least partially surrounding each core structure of the plurality of core structures, the support material comprising a second deformable polymer material differing in composition from the first deformable polymer material of the plurality of core structures; wherein each core structure of the plurality of core structures is integrally interconnected along a length thereof to no more than two other core structures of the plurality of core structures.

Embodiment 2: The cushion of Embodiment 1, wherein each core structure of the plurality of core structures is isolated along the length thereof from each of the other core structures of the plurality of core structures by the support material.

Embodiment 3: The cushion of any one of Embodiments 1 through 6, wherein at least two core structures of the plurality of core structures are interconnected by a rib member extending along a length of each of the at least two core structures and integrally formed with the at least two core structures.

Embodiment 4: The cushion of Embodiment 3, wherein the plurality of core structures comprises a plurality of lines of interconnected core structures, the core structures in each line of interconnected core structures being interconnected to at least one other core structure in the line of interconnected core structures by an integral rib member.

Embodiment 5: The cushion of any one of Embodiments 1 through 4, wherein the support material comprises a unitary body of support material having a plurality of recesses therein, each core structure of the plurality of core structures disposed respectively within a recess of the plurality of recesses in the unitary body of support material.

Embodiment 6: The cushion of any one of Embodiments 1 through 5, wherein each core structure of the plurality of core structures is configured to buckle when compressed along the column axis of the core structure to a pressure beyond a threshold pressure level.

Embodiment 7: The cushion of any one of Embodiments 1 through 6, wherein the first deformable polymer material comprises gel.

Embodiment 8: The cushion of any one of Embodiments 1 through 7, wherein the second deformable polymer material comprises foam.

Embodiment 9: The cushion of any one of Embodiments 1 through 8, wherein the column axes of the core structures of the plurality of core structures are oriented generally parallel to one another, and the column axes of the core structures of the plurality of core structures are oriented perpendicular to a cushioning surface of the cushion.

Embodiment 10: The cushion of any one of Embodiments 1 through 9, wherein at least one of top ends and bottom ends of the core structures of the plurality of core structures are interconnected by at least one of fabric and a skin layer.

Embodiment 11: A cushion, comprising: a plurality of core structures, each core structure of the plurality of core structures comprising a gel material, each core structure of the plurality of core structures configured as a column having a column axis, each core structure of the plurality of core structures being interconnected along a length thereof to no more than two other core structures of the plurality of core structures; and a support material at least partially surrounding each core structure of the plurality of core structures, the support material comprising a unitary body of deformable polymer foam having a plurality of recesses therein, each core structure of the plurality of core structures disposed respectively within a recess of the plurality of recesses in the unitary body of support material; wherein each core structure of the plurality of core structures is configured to buckle within a recess of the plurality of recesses in the unitary body of deformable polymer foam when compressed along the column axis of the core structure to a pressure beyond a threshold pressure level.

Embodiment 12: The cushion of Embodiment 11, wherein each core structure of the plurality of core structures is isolated along the length thereof from each of the other core structures of the plurality of core structures by the support material.

Embodiment 13: The cushion of Embodiment 11, wherein at least two core structures of the plurality of core structures are interconnected by a rib member extending along the length of the at least two core structures and integrally formed with each core structure of the at least two core structures.

Embodiment 14: The cushion of Embodiment 13, wherein the plurality of core structures comprises a plurality of lines of interconnected core structures, the core structures in each line of interconnected core structures being interconnected to at least one other core structure in the line of interconnected core structures by an integral rib member.

Embodiment 15: The cushion of any one of Embodiments 11 through 14, wherein the column axes of the core structures of the plurality of core structures are oriented generally parallel to one another, and the column axes of the core structures of the plurality of core structures are oriented perpendicular to a cushioning surface of the cushion.

Embodiment 16: The cushion of any one of Embodiments 11 through 15, wherein at least one of top ends and bottom ends of the core structures of the plurality of core structures are interconnected by at least one of fabric and a skin layer.

Embodiment 17: A method of forming a cushion, comprising: forming a plurality of core structures each comprising a first deformable polymer material and configured as a column having a column axis; and at least partially surrounding each core structure of the plurality of core structures with a support material comprising a second deformable polymer material differing in composition from the first deformable polymer material of the plurality of core structures; configuring each core structure of the plurality of core structures to be integrally interconnected along a length thereof to no more than two other core structures of the plurality of core structures.

Embodiment 18: The method of Embodiment 17, wherein configuring each core structure of the plurality of core structures to be integrally interconnected along a length thereof to no more than two other core structures of the plurality of core structures comprises configuring each core structure of the plurality of core structures to be integrally interconnected along a length thereof to no other core structures of the plurality of core structures.

Embodiment 19: The method of Embodiment 17 or Embodiment 18, further comprising at least substantially laterally isolating each core structure of the plurality of core structures from all other core structures of the plurality of core structures by the support material.

Embodiment 20: The method of Embodiment 17, further comprising interconnecting at least two core structures of the plurality of core structures with a rib member extending along a length of each of the at least two core structures and integrally formed with the at least two core structures.

Embodiment 21: The method of Embodiment 20, further comprising forming the plurality of core structures to comprise a plurality of lines of interconnected core structures by interconnecting the core structures in each line of interconnected core structures to at least one other core structure in the line of interconnected core structures with an integral rib member.

Embodiment 22: The method of any one of Embodiments 17 through 21, further comprising interconnecting at least one of top ends and bottom ends of the core structures of the plurality of core structures using at least one of fabric and a skin layer.

Embodiment 23: The method of any one of Embodiments 17 through 22, further comprising: orienting the column axes of the core structures of the plurality of core structures generally parallel to one another; and orienting the column axes of the core structures of the plurality of core structures perpendicular to a cushioning surface of the cushion.

Embodiment 24: The method of any one of Embodiments 17 through 23, further comprising: forming the support material to comprise a unitary body of support material having a plurality of recesses therein; and disposing each core structure of the plurality of core structures respectively within a recess of the plurality of recesses in the unitary body of support material.

Embodiment 25: The method of any one of Embodiments 17 through 24, further comprising configuring each core structure of the plurality of core structures to buckle when compressed along a column axis of the core structure to a pressure beyond a threshold pressure level.

Embodiment 26: The method of any one of Embodiments 17 through 25, further comprising selecting the first deformable polymer material to comprise gel.

Embodiment 27: The method of any one of Embodiments 17 through 26, further comprising selecting the second deformable polymer material to comprise foam.

Embodiments of the invention may be susceptible to various modifications and alternative forms. Specific embodiments have been shown in the drawings and described in detail herein to provide illustrative examples of embodiments of the invention. However, the invention is not limited to the particular forms disclosed herein. Rather, embodiments of the invention may include all modifications, equivalents, and alternatives falling within the scope of the invention as defined by the following appended claims. Furthermore, elements and features described herein in relation to some embodiments may be implemented in other embodiments of the invention, and may be combined with elements and features described herein in relation to other embodiments to provide yet further embodiments of the invention.

What is claimed is:

1. A cushion, comprising:

a plurality of core structures, each core structure of the plurality of core structures comprising a first deformable polymer material, each core structure of the plurality of core structures configured as a column having a column axis; and a support material at least partially surrounding each core structure of the plurality of core structures, the support material comprising a second deformable polymer material differing in composition from the first deformable polymer material of the plurality of core structures;

wherein each core structure of the plurality of core structures is integrally interconnected along a length thereof to no more than two other core structures of the plurality of core structures; and wherein the support material comprises a unitary body of support material having a plurality of recesses therein, each core structure of the plurality of core structures disposed respectively within a recess of the plurality of recesses in the unitary body of support material.

2. The cushion of claim 1, wherein each core structure of the plurality of core structures is isolated along the length thereof from each of the other core structures of the plurality of core structures by the support material.

3. The cushion of claim 1, wherein each core structure of the plurality of core structures is configured to buckle when compressed along the column axis of the core structure to a pressure beyond a threshold pressure level.

4. The cushion of claim 1, wherein the first deformable polymer material comprises gel.

5. The cushion of claim 1, wherein the second deformable polymer material comprises foam.

6. The cushion of claim 1, wherein at least two core structures of the plurality of core structures are interconnected by a rib member extending along a length of each of the at least two core structures and integrally formed with the at least two core structures.

7. The cushion of claim 6, wherein the plurality of core structures comprises a plurality of lines of interconnected core structures, the core structures in each line of interconnected core structures being interconnected to at least one other core structure in the line of interconnected core structures by an integral rib member.

8. The cushion of claim 1, wherein the column axis of the core structures of the plurality of core structures are oriented generally parallel to one another, and the column axis of the core structures of the plurality of core structures are oriented perpendicular to a cushioning surface of the cushion.

9. The cushion of claim 1, wherein at least one of top ends and bottom ends of the core structures of the plurality of core structures are interconnected by at least one of fabric and a skin layer.

10. A cushion, comprising:

a plurality of core structures, each core structure of the plurality of core structures comprising a gel material, each core structure of the plurality of core structures configured as a column having a column axis, each core structure of the plurality of core structures being interconnected along a length thereof to no more than two other core structures of the plurality of core structures; and a support material at least partially surrounding each core structure of the plurality of core structures, the support material comprising a unitary body of deformable polymer foam having a plurality of recesses therein, each core structure of the plurality of core structures disposed respectively within a recess of the plurality of recesses in the unitary body of support material;

wherein each core structure of the plurality of core structures is configured to buckle within a recess of the plurality of recesses in the unitary body of deformable polymer foam when compressed along the column axis of the core structure to a pressure beyond a threshold pressure level.

11. The cushion of claim 10, wherein each core structure of the plurality of core structures is isolated along the length thereof from each of the other core structures of the plurality of core structures by the support material.

12. The cushion of claim 10, wherein at least two core structures of the plurality of core structures are interconnected by a rib member extending along the length of the at least two core structures and integrally formed with each core structure of the at least two core structures.

13. The cushion of claim 10, wherein the plurality of core structures comprises a plurality of lines of interconnected core structures, the core structures in each line of interconnected core structures being interconnected to at least one other core structure in the line of interconnected core structures by an integral rib member.

14. The cushion of claim 10, wherein the column axis of the core structures of the plurality of core structures are oriented generally parallel to one another, and the column axis of the core structures of the plurality of core structures are oriented perpendicular to a cushioning surface of the cushion.

15. The cushion of claim 10, wherein at least one of top ends and bottom ends of the core structures of the plurality of core structures are interconnected by at least one of fabric and a skin layer.

16. A method of forming a cushion, comprising:

forming a plurality of core structures each comprising a first deformable polymer material and configured as a column having a column axis;

disposing each core structure of the plurality of core structures respectively within a recess of a plurality of recesses in a unitary body of support material to at least partially surround each core structure of the plurality of core structures with the support material, the support material comprising a second deformable polymer material differing in composition from the first deformable polymer material; and configuring each core structure of the plurality of core structures to be integrally interconnected along a length thereof to no more than two other core structures of the plurality of core structures.

17. The method of claim 16, wherein configuring each core structure of the plurality of core structures to be integrally interconnected along a length thereof to no more than two other core structures of the plurality of core structures comprises configuring each core structure of the plurality of core structures to be integrally interconnected along a length thereof to no other core structures of the plurality of core structures.

18. The method of claim 16, further comprising at least substantially laterally isolating each core structure of the plurality of core structures from all other core structures of the plurality of core structures by the support material.

19. The method of claim 16, further comprising configuring each core structure of the plurality of core structures to buckle when compressed along a column axis of the core structure to a pressure beyond a threshold pressure level.

20. The method of claim 16, further comprising selecting the first deformable polymer material to comprise gel.

21. The method of claim 16, further comprising selecting the second deformable polymer material to comprise foam.

22. The method of claim 16, further comprising interconnecting at least two core structures of the plurality of core structures with a rib member extending along a length of each of the at least two core structures and integrally formed with the at least two core structures.

23. The method of claim 22, further comprising forming the plurality of core structures to comprise a plurality of lines of interconnected core structures by interconnecting the core structures in each line of interconnected core structures to at least one other core structure in the line of interconnected core structures with an integral rib member.

24. The method of claim 16, further comprising:

orienting the core structures of the plurality of core structures generally parallel to one another; and orienting the column axis of the core structures of the plurality of core structures perpendicular to a cushioning surface of the cushion.

25. The method of claim 16, further comprising interconnecting at least one of top ends and bottom ends of the core structures of the plurality of core structures using at least one of fabric and a skin layer.

* * * * *